United States Patent [19]

Weisensel

[11] 4,336,165

[45] Jun. 22, 1982

[54] DEFOAMING POWDERED CARPET CLEANING COMPOSITION FOR USE IN EXTRACTION CLEANING

[75] Inventor: Hubert C. Weisensel, Racine County, Wis.

[73] Assignee: S. C. Johnson & Son, Inc., Racine, Wis.

[21] Appl. No.: 199,807

[22] Filed: Oct. 23, 1980

Related U.S. Application Data

[62] Division of Ser. No. 51,095, Jun. 22, 1979.

[51] Int. Cl.[3] ..... C11D 1/835; C11D 3/10

[52] U.S. Cl. ..... 252/528; 252/106

[58] Field of Search ..... 252/DIG. 1, DIG. 14, 252/528, 547; 8/137

[56] References Cited

U.S. PATENT DOCUMENTS

| | | | |
|---|---|---|---|
| 2,599,127 | 6/1952 | Resuggan | 252/106 |
| 3,223,644 | 12/1965 | Law | 252/106 |
| 3,247,119 | 4/1966 | Herrick et al. | 252/106 |
| 3,330,767 | 7/1967 | Herrick et al. | 252/106 |
| 3,553,143 | 1/1971 | Bauer | 252/528 X |
| 3,694,365 | 9/1972 | Castner | 252/106 |
| 3,836,669 | 9/1974 | Dadekian | 424/329 |
| 4,065,409 | 12/1977 | Flanagan | 252/528 |

FOREIGN PATENT DOCUMENTS 466276 6/1975 U.S.S.R. .

OTHER PUBLICATIONS

Bennett, H., "The Chemical Formulary", vol. XIII, 1967, Chemical Publishing Co., Inc., N.Y., 1967, pp. 386, 387.

Bennett, H., "The Chemical Formulary", vol. XV, 1970, Chemical Publishing Co., Inc., N.Y., pp. 184, 185, 187, 188, 189.

Bennett, H., "The Chemical Formulary", vol. XVI, Chemical Publishing Co., N.Y., 1971, pp. 155, 156.

Bennett, H., "The Chemical Formulary", vol. XIX, Chemical Publishing Co., N.Y., 1976, pp. 252, 253, 257, 258.

*Primary Examiner*—P. E. Willis, Jr.

[57] ABSTRACT

A powdered composition for simultaneously cleaning a carpet and defoaming any high-foaming residue removed from the carpet using the water extraction cleaning method which comprises contacting the carpet with said powdered composition mixed with water, vacuuming the carpet, wherein said composition includes sufficient cationic surfactant to interact with any high-foaming anionic detergent removed from the carpet.

1 Claim, No Drawings

DEFOAMING POWDERED CARPET CLEANING COMPOSITION FOR USE IN EXTRACTION CLEANING

This is a division, of application Ser. No. 51,095, filed June 22, 1979.

BACKGROUND OF THE INVENTION

This invention relates to a composition and process for using the same in hot water extraction cleaning of carpeting. More particularly, this invention relates to a composition containing an inherent anti-foaming agent such that the use of an additional defoaming agent is not necessary.

Extraction cleaning of carpeting both by consumers and by professional carpet cleaners is a well known carpet cleaning technique. Typically, extraction cleaning may be utilized between heavy duty foam carpet cleanings to maintain the appearance of carpeting especially where the carpet is subjected to heavy traffic. Some advanages of extraction cleaning over heavy duty foam carpet cleaning are that moisture, dirt, and shampoo residue are physically removed from the carpet. One problem encountered utilizing extraction carpet cleaning, especially when the carpet has previously been cleaned utilizing a cleaner with high foaming anionic surfactants such as sodium lauryl sulfate, is the residue of the high foaming surfactant contained within the carpet creates a large volume of foam within the vacuum receptacle of the extraction cleaning equipment. Defoaming this high foaming residue is essential to efficient machine operation, but can create difficulties especially in commercial equipment as this equipment may have a sealed vacuum chamber and any foam buildup may be difficult to control or dispose of, and take a considerable amount of the operator's time. Home or consumer extraction cleaning equipment may be of similar design, or may be more easily controlled by the addition of extra anti-foam agent to the vacuum chamber.

One method to inhibit the foaming caused by the residue of a high-foaming surfactant which may have been used to clean the carpet, is to spray an anti-foam agent over the entire carpet area to be cleaned just prior to the extraction cleaning of the carpet. This method, although generally satisfactory, has a number of disadvantages. First, it adds an extra step to the process of cleaning the carpeting and second, as many anti-foam agents are oily materials, should all the anti-foam not be removed from the carpet, a spot may remain which could stain the carpet or be subject to quicker resoiling when subjected to traffic. A second method using the anti-foam is to predetermine the amount of anti-foam agent which will be required and vacuum this agent directly into the extraction cleaner vacuum chamber. This has a disadvantage in that extra anti-foam agent needs to be used in order to insure that the foam will not build up within the vacuum chamber. The build up of foam within a commercial unit's vacuum chamber can have serious consequences for the operator in terms of difficult removal of foam and lengthy machine downtime. The subsequent addition of defoamers through the vacuum hose to the vacuum chamber once a foam problem has occurred will break foam only if it comes in contact with the foam. Some machines are designed such that once foam has formed, it is difficult to get defoamers added through the vacuum hose to actually contact and break the foam in the tank.

BRIEF DESCRIPTION OF THE INVENTION

The present invention relates to improved carpet-cleaning compositions for use in extraction carpet cleaning machinery which will effectively clean the carpeting utilizing the water extraction technique while at the same time inhibit the formation of foam created by the residue of high-foaming surfactants which may have been used previously to clean the carpeting. The composition may be either in liquid or powder form. The powdered composition incorporates from 2 to 15% by weight based on the weight of the cleaning composition concentrate of a low-foaming cationic surfactant, from 1 to 15% by weight nonionic surfactant and from 97 to 70% by weight builders.

The liquid extraction cleaner concentrate composition comprises from 1 to 15% by weight of a low-foaming cationic surfactant, from 1 to 15% by weight of a low-foaming nonionic surfactant, from 1 to 15% by weight of a builder, from 1 to 10% by weight of a chelating agent and from 96 to 55% by weight water.

The method of the present invention comprises a process for cleaning the carpet using a hot or cold water extraction system comprising: (a) spraying the carpet with a cleaning dispersion of a cleaning composition mixed with water having a temperature within the range of from 50° to 200° F.; (b) substantially simultaneously removing the cleaning dispersion from the carpet using a vacuum with a water lift rating of 100 inches to 250 inches, the improvement of which comprises controlling foam formation caused by the residue of high-foaming anionic detergents contained within the carpet being cleaned by using as the cleaning dispersion a composition which includes from 0.01 to 3.75% by weight of a low-foaming cationic surface active agent.

OBJECTS AND ADVANTAGES

It is the primary object of the present invention to provide a method for simultaneously cleaning a carpet and controlling the foam caused by the residue contained within the carpet using a water extraction cleaning method.

It is a further object of the present invention to provide a composition for use with water extraction and cleaning equipment which simultaneously cleans the carpets and controls foam formation caused by residue of high-foaming anionic detergents contained with the carpets.

It is a still further object of the present invention to provide a composition which incorporates an antifoaming agent into the active cleaning composition without substantially detracting from the effectiveness of the cleaning composition.

A still further object is to provide a composition wherein the anti-foaming agent is a compatible part of the entire cleaning composition, and does not separate out in the solution feed tank, as silicone defoamers do if incorporated into cleaners.

Still further objects of the composition and method of the present invention will become more apparent from the following more detailed explanation.

DETAILED DESCRIPTION OF THE INVENTION

The cleaning compositions of the present invention are liquid or dry powder concentrate compositions designed to be diluted in water to have a final use dilution within the range of from about one part concentrate to 4 parts water to one part concentrate to 256 parts of water. The powder extraction cleaner concentrate comprises from 2 to 15% by weight of a low-foaming cationic surfactant, from 1 to 15% by weight of a low foaming nonionic detergent and from 70 to 97% by weight builders.

The liquid extraction cleaner concentrate composition comprises from 1 to 15% by weight of a low-foaming cationic surfactant, from 1 to 15% by weight of a low-foaming nonionic surfactant, from 1 to 15% by weight of a builder, from 1 to 10% by weight of a chelating agent and from 96 to 55% by weight water.

The improved process of the present invention for simultaneously cleaning the carpet using a water extraction system and providing foam control comprises (a) spraying the carpet with a cleaning dispersion of a concentrate cleaning composition mixed with water in a ratio of one part concentrate to 4 parts water to one part concentrate to 256 parts water, the water having a temperature within the range of from 50° to 200° F.; (b) substantially simultaneously removing the cleaning dispersion from the carpet using a vacuum with a water lift rating of 100 inches to 250 inches, the improvement which comprises controlling foam formation caused by residues of high-foaming anionic detergents contained within the carpet being cleaned by using as the cleaning dispersion a composition which includes from 0.01 to 3.75% by weight of a low-foaming cationic surface active agent. The improved compositions and process of the present invention operate to inhibit foam formation in a manner substantially different than the compositions previously used in the carpet cleaning art. Prior compositions utilize a two part composition wherein one part is the cleaning composition and the second part is the defoaming or foam-control agent. Generally, prior art foam-control agents function by changing the surface properties of the container to create an environment which does not favor foam formation. Alternately, they can function to break foam once it has formed, if contact between the defoamer and the foam can be achieved.

When used in this specification and in the attached claims the term "Low Foaming" means either a material produces little foaming in an aqueous system or the material produces a foam which is not stable and breaks rapidly.

Contrary to these principals, the compositions and process of the present invention operate by chemically complexing the high foam-containing agents to inhibit the foam formation. In other words, the anionic surfactants present as residue in the carpet chemically react with the cationic foam control agents utilized in the present invention to reduce their foam stabilizing capacity on a continuous basis in a hot or cold water extraction system process. Also, it has been found that by use of certain other surfactants and builders along with the cationic composition that this interaction between the cationic foam control agent and the anionic surfactant present in the residue in the carpet can take place without interfering with the cleaning of the carpeting in an effective and expeditious manner.

The primary anti-foam ingredient used in the compositions and method of the present invention is a low-foaming cationic surface active agent. Generally from 1 to 15% by weight based on the active concentrate weight of this low-foaming material is utilized in both the liquid and powder forms and it is preferred to use between 2.5 and 7.5% by weight cationic. Although any cationic surfactant that is not compatible with anionic could be utilized in the composition of the present invention to fulfill the foam-control functions, should the composition be utilized on a carpet not previously treated with a high-foaming anionic detergent, the cationic surfactant itself if it is high foaming could create a foaming problem within the vacuum tank of the water extraction apparatus. For this reason it is preferred to utilize a low-foaming cationic surface active agent as the foam control agent.

The cationic surface active agents most suitable for use in the composition and process of the present invention include the quaternary ammonium compounds that are anionic-incompatible. Many quaternary ammonium compounds tend to be low foaming materials. The cationic compounds should be sufficiently soluble or dispersable in aqueous systems so as not to form a precipitate by itself within the diluted system within the time of the cleaning operation. Further, it is necessary that this material be sufficiently soluble or dispersable so that it effectively interacts with any anionic surfactant which may be picked up by the cleaning method from the residue previously contained in the carpet. By being in solution, or dispersed, the cationic composition is in the best position to deactivate the foam stabilizing ability of any anionic detergents which may be present as a residue in the carpet.

Suitable quarternary ammonium compounds have the general formula

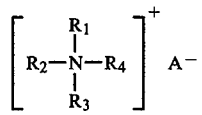

wherein $R_1$ is selected from the group consisting of lower alkyl group having 1 to 4 carbon atoms such as methyl, ethyl, propyl, isopropyl, butyl isobutyl or tertiary butyl and hydroxyl substituted lower alkyl group having 1 to 4 carbon atoms such as hydroxy ethyl, hydroxy propyl and the like; $R_2$ is an alkyl group having from 8 to 18 carbon atoms and mixtures thereof; $R_3$ is a alkyl group having from 1 to 18 carbon atoms; and wherein $R_4$ is selected from lower alkyl having from 1 to 4 carbon atoms such as methyl, ethyl, propyl, isopropyl, butyl isobutyl and tertiary butyl, hydroxy substituted lower alkyl groups having 1 to 4 carbon atoms; and an aryl group or alkyl aryl group wherein the alkyl group has from 1 to 4 carbon atoms and wherein A is an anion imparting water solubility to the composition such as chlorine, iodine, bromine, methyl sulphate, ethyl sulphate and the like.

Examples of the above quaternary ammonium compounds which are suitable for use in the composition of the present invention include dioctyl dimethyl ammonium chloride, mixed higher alkyl dimethyl benzyl ammonium chloride, mixed higher alkyl dimethyl ethyl benzyl ammonium chloride, methyl bis-2 hydroxyethyl coco ammonium chloride, di-higher alkyl dimethyl ammonium chloride, tallow amidoethyl imidazolinium methyl sulfate, tallow dimethyl ammonium methyl sulfate, and the like.

Ethoxylated quaternary ammonium compounds are less preferred because of greater compatibility with anionics, which slows down the rate of pecipitation of the anionic, and, depending on the degree of ethoxylation, may remain soluble and prevent precipitation.

In addition to the quaternary cationic materials, imidazolimium quaternary compounds and amines which are anionic-incompatible also are useful as the low-foaming cationic foam-control agent in the composition of the present invention.

As noted above, it is preferred that the cationic foam-control agent be low foaming itself, as well as imcompatible with anionics. It is a simple two-step process to determine whether or not a candidate cationic material is suitable for use in the composition of the present invention. First, a small amount, such as 0.1%, of the cationic material is dissolved in hot water and placed in a closed jar and shaken. If the composition generates significantly less foam than high-foaming surfactants such as sodium lauryl sulfate at the same concentration, and if foam generated is unstable and of short duration, then the composition is a candidate for the present invention. Second, to the same jar with cationic is added an equal amount on an actives basis of a high-foaming anionic surfactant, such as sodium lauryl sulfate, which is found in most foamy carpet shampoos. The sample is observed after one minute and five minutes to determine if turbidity and incompatability occur. The presence of turbidity indicates incompatability and anti-foaming properties, and is confirmed by shaking the sample with a resulting low degree of foaming. Cold water can be used for the above test, but the length of time allowed for incompatability to occur must be increased because the reaction is slower. Compositions that meet the low-foaming, and, most importantly, the incompatability with anionic test requirements, are suitable for use in the compositions of the present invention.

It is critical for the compositions and method of the present invention that the cationic surface active agent used be anionic incompatable and form a precipitate or turbidity in the presence of an anionic surfactant. Further, the compositions on dilution must contain sufficient cationic material to interact with most of the anionic residue removed from the carpet being cleaned. For the method it is critical that at least 0.01% by weight of the cleaning dispersion used to clean the carpets be cationic material. Below this limit sufficient cationic may not be present to act as an effective anti-foam agent. The upper limit is primarily economic, however, no appreciable increase in performance is evident at amounts of greater than 3.75% by weight. The preferred amount of cationic within the dispersion is from 0.01 to 1.2% as this is the range which offers the best performance at lowest cost and highest concentrate and dispersion stability. The optimum range is from 0.03 to 0.2% by weight. It should be recognized that use dilution of the products of the present invention may vary widely. It has been found that dilutions to produce the above ranges will effectively clean the carpet using an extraction technique and inhibit the formation of stable foam.

The composition of the present invention includes as a primary cleaning agent a nonionic surfactant. Generally from 1 to 15% by weight of nonionic should be used. It is preferred to use from 2 to 10% by weight nonionic. Substantially any nonionic surfactant can be utilized in the composition of the present invention for detergency so long as the same is low foaming. The use of nonionic surfactants in water extraction cleaning compositions is conventional and any conventionally used nonionic surfactant can be utilized in the composition of the present invention. Suitable nonionic surfactants include the following: Suitable nonionic surfactants include alkyl ethoxylates of the general formula $$R-(OCH_2CH_2)_n-OH$$

wherein R is from $C_9$–$C_{18}$ and n is from 1–100. R can be straight chain or branched chain.

Also included are ethoxylated propoxylated alcohols of the general formula $$R-(O-CH_2\overset{\overset{CH_3}{|}}{C}H)_m-(O-CH_2CH_2)_n-OH$$

or $$R-(O-CH_2CH_2)_n-(O-CH_2\overset{\overset{CH_3}{|}}{C}H)_m-OH$$

wherein R is from $C_9$–$C_{18}$, n is from 1–100, and m is from 1–100. Also block polymers of ethylene oxide and propylene oxide may be used as well as alkylated amines.

Also included are alkyl aryl ethoxylates of the general formula

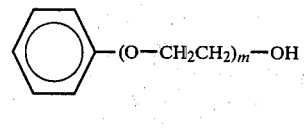

wherein R is $C_8$–$C_{10}$ and m is from 1–40.

Suitable commercially available nonionics within the above groups include Plurafac D25, Surfonic LF-17, The Tergitols such as Tergitol 15-S-7, blends within the Triton X and N series, octyl phenol ethoxylates and nonyl phenol ethoxylates, the Neodols such as Neodol 91-6, the Pluronic block polymers such as Pluronic L61, The Tetronics, ethylene diamine ethoxylate/propoxylates and the Pluradots, trifunctional polyoxyalkylene glycols. The nonionics are conventional for these types of cleaners and substantially any good cleaning, reasonably low-foaming nonionic can be used.

The balance of the liquid concentrate is liquid, preferably water, although some small amount of solvent such as water miscible alcohols, glycol ethers, or chlorinated solvents can be used. Total liquid should range from 92 to 55% by weight water.

The composition of the present invention also includes builders, chelating agents, and fillers. These materials are alkaline materials which provide cleaning function to the composition of the present invention. These are generally inorganic materials such as phosphates, silicates, carbonates, sulfates, and the like and may be present in any amount ranging from 1 to 15% by weight based on the weight of the concentrate for the liquid and 75 to 95% by weight for the powders. Preferred builders include sodium tripolyphosphate, potassium tripolyphosphate, sodium carbonate, tetrapotassium pyrophosphate, sodium metasilicate and mixtures thereof. Also, the hydrated and anhydrous forms of many builders may be used such as sodium tripolyphosphate hexahydrate, anhydrous sodium tripolyphosphate, sodium metasilicate pentahydrate and the like. It is generally preferred that at least some phosphate builder be present although the other builders such as the carbonates, silicates and the like can be present in substantial amounts, i.e. from 5 to 95% by weight based on weight of the builders. It should be noted that the builders are conventional agents utilized in hot water extraction cleaning compositions. Accordingly, substantially any combination of conventional builders can be incorporated into the composition of the present invention so long as they are compatible with cationics, and the total builder content and filler content be within the range of from 70 to 97% by weight of the weight of the concentrate for the dry powder product and from 1 to 15% by weight for the liquid product.

Chelating agents to complex hard water ions can be used to add to the effectiveness of the detergency. Examples are $Na_4EDTA$ and $Na_3NTA$. These materials are primarily used in the liquid composition in amounts of from 1 to 10% by weight. They can optionally be incorporated into the dry products in an amount of 1 to 10% by weight.

The concentrate composition of the present invention can also include small amounts of perfumes, optical brighteners and dyes. These materials should be present in small amounts not exceeding 10% by weight of the weight of the concentrate so as not to interfere with the overall performance of the composition. These materials can add to the performance of the composition such as in the case of the optical brighteners however, their presence is not required. Obviously, these materials should not contribute significantly to foaming.

The compositions may also contain hardening and embittling agents such as polymers, resins, or silicas to reduce resoil properties of any residues left behind on the carpet. Generally these materials will be present in amounts of less than 10% in either the liquid or powder products.

The composition of the end process of the present invention will now be illustrated by way of the following examples wherein all parts and percentages are by weight.

Examples attached.

EXAMPLE 1

A dry powder extraction cleaner concentrate having the following formula was prepared by cold blending all components but the perfume and nonionic surfactant. These liquid components were mixed together and sprayed over the dry mixture while continuing to mix:

| | |
|---|---|
| Sodium tripolyphosphate hexahydrate | 43.00% |
| Sodium carbonate | 24.25 |
| Sodium metasilicate pentahydrate | 15.00 |
| BTC 2125M-P40[1] | 12.50 |
| Plurafac D25[2] | 5.00 |
| Optical Brighteners | 0.10 |
| Perfume | 0.150 |

[1]BTC2125M-P40 - A mixture of 20% myristyl dimethyl benzyl ammonia chloride; 20% dodecyl dimethyl benzyl ammonium chloride and 60% urea

[2]Plurafac D25 - $R-(O-\underset{\underset{CH_3}{|}}{CH_2}-CH_2)_x-(O-CH_2-CH_2)_y-OH$ wherein R is a C12 to 18 alkyl, x is an average of 6 and y is an average of 11

The above formula was diluted 1 part concentrate to 128 parts of 140° F. water and compared to 2 commercially available powder products and 2 commercially available liquid products diluted as indicated on the label instructions. Each product was used to clean 2 different carpets using a Steamex Extractor with a 10" head. The carpets were heavily soiled by foot traffic. The results are shown in Table I.

TABLE I

| | Example 1 | Control | Commercial Product $A_3$ | $B_4$ | $C_5$ | $D_6$ |
|---|---|---|---|---|---|---|
| Product Form | Powder | | Powder | Powder | Liquid | Liquid |
| Dilution oz/gal. | 1 | | 1 | 1 | 2 | 2 |
| pH at dilution | 11.5 | | 11.3 | 11.9 | 11.0 | 11.1 |
| % Cleaning Actives at dilution | 0.56 | | 0.72 | 0.72 | — | 0.31 |
| Cleaning rating: | | | | | | |
| Carpet $A_1$ | | | | | | |
| 2 passes | 2.1 | 5 | 2.5 | 2.7 | 3 | 3 |
| 4 passes | 1 | 5 | 1.2 | 1.5 | 2 | 2 |
| Carpet $B_2$ | | | | | | |
| 2 passes | 1.3 | 3 | 1.3 | 1.6 | 1.7 | 1.8 |
| 4 passes | 1 | 3 | 1.2 | 1.5 | 1.6 | 1.6 |

1 - Carpet A - a brown/white nylon loop.
2 - Carpet B - a gold polypropylene loop.
3 - Commercial Product A - Dynasurf Mintex
4 - Commercial Product B - Ramsey Extract-A-Soil
5 - Commercial Product C - CMA liquid
6 - Commercial Product D - Chemko Emulsifier
7 - Cleaning rated visually by expert judges, 1 = Best As is apparent from the data, the product of Example 1 cleans slightly better than Commercial A and better than the other products. Further, only the product of Example 1 cleans residue-filled carpets without appreciable foam build-up in the equipment.

EXAMPLE 2

The cationics shown in Table II are subjected to the method of evaluating surfactants for suitability as antifoam agents of the present invention. Each surfactant was diluted with water having a temperature of 140° F. in 5½" 8 oz. bottles, to give a 0.1% solution of surfactant in 100 grams of water. The bottle was capped and inverted gently 5 times to mix the product and water without generating foam. The bottle was then shaken 10 times and the foam height and clarity observed immediately and again after the interval shown in Table I. After the foam, if any, has broken, 0.070% of sodium lauryl sulfate is added and allowed to rest for one minute before shaking 5 times, observing the contents and shaking 5 more times. The foam height and turbidity are observed immediately after shaking and again after the time shown in Table I and again after 5 minutes. The maximum foam height is 2½".

TABLE II

| | | Foam Height (in.) | | | | Appearance | | | |
|---|---|---|---|---|---|---|---|---|---|
| | | Cationic Alone | | Cationic + NaLS | | Cationic Alone | Cationic + NaLS | | Anionic |
| Run | Cationic | Immed. | Interval[1] | Immed. | 5 Mins. | Immed. | Immed. | 5 Mins. | Compatible |
| A | Bardac $LF_2$ | 0.5 | 0, 2 | Trace | 0 | Clear | Turbid | Opaque | No |

TABLE II-continued

| Run | Cationic | Foam Height (in.) Cationic Alone Immed. | Cationic Alone Interval[1] | Cationic + NaLS Immed. | Cationic + NaLS 5 Mins. | Appearance Cationic Alone Immed. | Cationic + NaLS Immed. | Cationic + NaLS 5 Mins. | Anionic Compatible |
|---|---|---|---|---|---|---|---|---|---|
| B | BTC-2125M[3] | 2.5 | 0 | 0.25 | 0.25 | Clear | Turbid | Opaque | No |
| C | BTC-2125M-P40[4] | 2.5 | 0 | 0.25 | 0.25 | Clear | Turbid | Opaque | No |
| D | BTC-776[5] | 2.5 | 2, 5 | 0.25 | 0 | Clear | Turbid | Opaque | No |
| E | Adogen 432-CG[6] | 1.12 | 1.0, 30 | 0.25 | 0.12 | Clear | Turbid | Opaque | No |
| F | Varonic T-202[7] | 0.25 | * | 1.00 | 0.75 | Hazy | Sl. Haze | Sl. Haze | Partial |
| G | Variquat 638[8] | 2.5 | 2.5 | 0.87 | 0.75 | Clear | Turbid | Opaque | No |
| H | Varisoft 472[9] | 0.37 | 0.25 | 0.25 | Trace | Sl. Haze | Turbid | Opaque | No |
| I | Varisoft 238[10] | 0.62 | 0.37 | 1.00 | 0.5 | Clear | Hazy | Hazy | Partial |
| J | StepantexQ90B[11] | 0.12 | — | 0.12 | 0 | Turbid | Opaque | Opaque | No |
| K | Onxyperse 12[12] | 0.25 | 0, 5 | 1.25 | 1.00 | Clear | Turbid | Turbid | No |
| L | Emulsifier 3[13] | 1.00 | 0.75 | 0.50 | 0.15 | Sl. Haze | Turbid | Turbid | No |

[1]Interval - The first number is the foam height in inches, the second number is time of interval in seconds if different from 15 seconds.
[2]Bardac LF - Dioctyl dimethyl ammonium chloride.
[3]BTC-2125M - 50/50 blend of dodecyl dimethyl ethylbenzyl ammonium chloride and Myristyl dimethyl benzyl ammonium chloride.
[4]BTC-2125M-P40 - A 40/60 mixture of BTC-2125M and urea.
[5]BTC-776 - A 50/50 mixture of alkyl dimethyl ammonium chloride and dialkyl methyl benzyl ammonium chloride.
[6]Adogen 432 CG - $diC_{16}$alkyl dimethyl ammonium chloride.
[7]Varonic T-202 - Ethoxylate (2EO) tallow amine.
[8]Variquat 638 - Methyl bis(2-hydroxyethyl) coco ammonium chloride.
[9]Varisoft 472 - Mixture of methyl tallow amidoethyl imidazolinium methyl sulfate and tallow dimethyl ammonium methyl sulfate.
[10]Varisoft 238 - Propoxylated fatty quaternary.
[11]Stepantex Q90B - Triethanol amine coco triester alkyl sulfate.
[12]Onxyperse 12 - Cationic polymer blend.
[13]Emulsifier 3 - Quaternary ammonium chloride (Tomah Chemicals)

The appearance of the cationic alone indicates the degree the cationic is soluble in water. A clear appearance indicates solution or high dispersion while haze and turbidity indicate some degree of nondispersability. The appearances after the anionic is added indicates the incompatability of the cationic with the anionic with clear being compatable and turbid, hazy or opaque being incompatable.

EXAMPLE 3

An extraction cleaner concentrate in liquid form was prepared by adding the following components:

| | |
|---|---|
| BTC 2125 | 5.0 |
| Plurafac D25 | 5.0 |
| Tetrapotassium pyrophosphate | 5.0 |
| NTA - $Na_3$ | 2.0 |
| Water | Balance to 100% |

The product was tested for foam control effect, the results are shown on Table III.

EXAMPLE 4

The following extraction cleaner concentrate was prepared using the procedure of EXAMPLE 1:

| | |
|---|---|
| BTC2125-P40 | 12.5 |
| Plurafac D25 | 5.0 |
| Sodium tripolyphosphate hexahydrate (77.3%) | 71.5 |
| Sodium metasilicate pentahydrate (57.6%) | 11.0 |

The product was tested for foam control effect, the results are shown on Table III.

EXAMPLE 5

A powdered concentrate having the following formula was prepared using the procedure of EXAMPLE 1:

| | |
|---|---|
| BTC2125M-P40 | 18.75 |
| Plurafac D25 | 5.00 |
| Sodium tripolyphosphate hexahydrate (77.3%) | 68.00 |
| Sodium metasilicate pentahydrate (57.6%) | 8.00 |
| Perfume | 0.15 |
| Optical brightener | 0.10 |
| | 100.00 |

This concentrate was tested for foam control effect, the results are shown on Table III.

COMPARATIVE EXAMPLES 1 AND 2

The following two powder concentrates were prepared by combining the following components:

| | CE 1 | CE 2 |
|---|---|---|
| Sodium tripolyphosphate hexahydrate (77.3%) | 46.00 | 46.00 |
| Sodium metasilicate pentahydrate (57.6%) | 46.00 | 46.00 |
| Plurafac D25 | 4.85 | 4.85 |
| Q2-3000 | 3.00 | — |
| AF-90 | — | 3.00 |
| Fragrance | 0.15 | 0.15 |
| | 100.00 | 100.00 |

These two concentrates were prepared using the method of EXAMPLE 1. They were tested for foam control effect. The results are shown in Table III.

A series of extraction cleaning concentrate formulations were tested for foam control effect by first scrubbing a $9\frac{1}{2} \times 16'$ carpet with a sodium lauryl sulfate carpet cleaner. The carpets were then extracted even before the shampoo had dried using a Steamex extraction machine with a 10" wand. 140° F. tap water was used for all dilutions. The number of square feet extracted before overflow or vacuum cut off were measured. The results are in Table III.

TABLE III

| Example | Dilution oz/gal. | Mileage $ft^2$ | Comments |
|---|---|---|---|
| 3 | 2 | 140 | Overflowed, good foam control |
| 4 | 1 | 95 | Overflowed, fair foam control |
| 4 | 2 | 150 | Low foam layer-much headspace |
| 5 | 1 | 130 | Light foam-Vacuum shut off |
| CE1 | 1 | 33 | Slightly better than control |
| CE2 | 1 | 80 | Product creams and separates |
| Control | Water Only | 20 | Lathery foam |

EXAMPLE 6

Using the screening procedure of EXAMPLE 2, the product of EXAMPLE 1 and the commercial products A & B from EXAMPLE 1 were tested for anti-foaming. The only difference in the procedure was that an 8 oz. bottle with 3" maximum foam height was used.

| Foam Height (in.) | Example 1 | Commercial Product A | Commercial Product B |
|---|---|---|---|
| Product Alone-initial | 1.25 | 2.0 | 0.25 |
| Product Alone-5 min. | 0.25 | 1.0 | 0.00 |
| Product + NaLS-initial | 0.25 | 3.0 | 3.0 |
| Product + NaLS-5 min. | 0.06 | 2.0 | 3.0 |

EXAMPLE 7

The following liquid concentrate extraction carpet cleaner was prepared by dissolving the brightener in the surfactant and the cationic. The remaining components are then added to this mixture.

| | |
|---|---|
| Plurafac D25 | 5.00 |
| Optical brightener | 0.10 |
| BTC 2125M (50%) | 10.0 |
| Water | 73.97 |
| Tetrapotassium pyrophosphate (60%) | 8.33 |
| Sodium NTA (40%) | 2.50 |
| Perfume | 0.10 |
| | 100.00 |

The above composition was compared to 5 commercial liquid extraction products for cleaning and foam control. The carpet used was a traffic soiled brown/white nylon loop. The foam control screen of EXAMPLE 2 was used except an 8 oz. bottle with maximum 3" foam height was used. All products were diluted 2 oz/gal. in 140° F. water and were applied to the carpet using a Steamex with a 10" wand.

| | Cleaning[6] 2 Passes | Cleaning[6] 4 Passes | Foam Height (in.) Product Alone Initial | Product Alone 5 Min | Product + NaLS Initial | Product + NaLS 5 Min | pH |
|---|---|---|---|---|---|---|---|
| Comm Prod A[1] | 3 | 2 | 3.0 | 2.0 | 3.0 | 2.25 | 9.4 |
| Comm Prod B[2] | 3 | 2.5 | 1.5 | 0.5 | 3.0 | 2.0 | 9.7 |
| Comm Prod C[3] | 3 | 2 | 1.50 | 1.0 | 3.0 | 3.0 | 10.9 |
| Comm Prod D[4] | 2.5 | 1 | 3.0 | 2.5 | 3.0 | 3.0 | 9.8 |
| Comm Prod E[5] | 3 | 2 | 2.25 | 1.0 | 3.0 | 2.0 | 11.0 |
| Blank | 4 | 4 | — | — | 3.0 | 3.0 | — |
| Ex. 7 | 2.5 | 1 | 2.25 | 0 | 0.5 | 0.12 | 9.7 |

[1]Comm Prod A = Dynasurf Dynabrite
[2]Comm Prod B = Clausen Steamy
[3]Comm Prod C = Ramsey Steamette
[4]Comm Prod D = Von Schrader Carpeteer
[5]Comm Prod E = Chemko Emulsifier
[6]Cleaning rated visually, 1 = Best

EXAMPLE 8

A liquid concentrate having the following formula was prepared:

| | |
|---|---|
| Water | 71.67 |
| Bardac LF (50%) | 10.00 |
| Surfonic LF-17[1] | 5.00 |
| Tetrapotassium pyro phosphate (60%) | 8.33 |
| Sodium NTA (40%) | 5.00 |
| | 100.00 |

[1]Surfonic LF-17 Alkyl polyoxyalklene ether - Jefferson Chemical.

This formula when diluted had good foam control properties and good cleaning.

EXAMPLE 9

The following liquid concentrate formula was prepared:

| | |
|---|---|
| Water | 71.67 |
| Plurafac D25 | 5.00 |
| Bardac LF (50%) | 10.00 |
| Tetrapotassium pyro phosphate (60%) | 8.33 |
| Sodium NTA (40%) | 5.00 |
| | 100.00 |

This formula when diluted with water had cleaning properties better than EXAMPLE 8 but had slightly lower foam control.

I claim:

1. A powdered carpet cleaning composition having inherent foam control which consists of 43% sodium tripolyphosphate hexahydrate; 24.25% sodium carbonate; 15% sodium metasilicate pentahydrate; 12.5% of a mixture of 20% myristyl dimethyl benzyl ammonium chloride, 20% dodecyl dimethyl benzyl ammonium chloride and 60% urea; 5% of a nonionic surfactant, having the formula $$R-(O-\underset{\underset{CH_3}{|}}{CH_2})-CH_2)_x-(O-CH_2-CH_2)_y-OH$$

wherein R is a $C_{12}$–$C_{18}$ alkyl, x is an average of 6 and y is an average of 11; 0.1% optical brightener; and 0.15% perfume.

* * * * *